US012173709B2

(12) United States Patent
Sato et al.

(10) Patent No.: US 12,173,709 B2
(45) Date of Patent: Dec. 24, 2024

(54) SCROLL COMPRESSOR

(71) Applicant: Panasonic Intellectual Property Management Co., Ltd., Osaka (JP)

(72) Inventors: Kazuya Sato, Gunma (JP); Daisuke Ogi, Shiga (JP); Takuji Sasa, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 18/554,387

(22) PCT Filed: May 30, 2022

(86) PCT No.: PCT/JP2022/021895
§ 371 (c)(1),
(2) Date: Oct. 6, 2023

(87) PCT Pub. No.: WO2022/264792
PCT Pub. Date: Dec. 22, 2022

(65) Prior Publication Data

US 2024/0183353 A1 Jun. 6, 2024

(30) Foreign Application Priority Data

Jun. 18, 2021 (JP) ..... 2021-101462

(51) Int. Cl.
*F04C 18/02* (2006.01)
*F04C 29/02* (2006.01)
*F04C 23/00* (2006.01)

(52) U.S. Cl.
CPC ..... *F04C 18/0215* (2013.01); *F04C 29/023* (2013.01); *F04C 29/028* (2013.01);
(Continued)

(58) Field of Classification Search
CPC .. F04C 2/025; F04C 15/0088; F04C 18/0215; F04C 23/008; F04C 29/02; F04C 29/023;
(Continued)

(56) References Cited

U.S. PATENT DOCUMENTS

2004/0247474 A1* 12/2004 Kitaura ..... F04C 29/023 418/94
2005/0069443 A1* 3/2005 Uekawa ..... F04C 29/023 418/55.3

(Continued)

FOREIGN PATENT DOCUMENTS

JP 2004-11482 A 1/2004
JP 2008-138578 A 6/2008

(Continued)

OTHER PUBLICATIONS

WO2018/220698A1—Misaka et al.—Scroll Compressor—Dec. 6, 2018—the English Machine Translation. (Year: 2018).*

(Continued)

*Primary Examiner* — Theresa Trieu
(74) *Attorney, Agent, or Firm* — HSML P.C.

(57) ABSTRACT

According to a scroll compressor of the present invention, a vertical groove is formed in the journal such that the vertical groove has a predetermined length measured from an upper end of the journal, a first oil supply hole and a second oil supply hole which are in communication with the main shaft oil supply hole and which open from the vertical groove are formed, a first opening of the first oil supply hole is located on a side of a lower end of the vertical groove, and a second opening of the second oil supply hole is located on a side of an upper end of the vertical groove. According to this configuration, an amount of oil supplied to the bearing can be increased, damage of the bearing can be reduced, and cooling ability and COP can be enhanced.

8 Claims, 5 Drawing Sheets

(52) U.S. Cl.
CPC ..... *F04C 23/008* (2013.01); *F04C 2240/50* (2013.01); *F04C 2240/603* (2013.01); *F04C 2240/809* (2013.01)

(58) Field of Classification Search
CPC .. F04C 29/025; F04C 29/028; F04C 2240/50; F04C 2240/603; F04C 2240/809
See application file for complete search history.

(56) References Cited

U.S. PATENT DOCUMENTS

| | | | | |
|---|---|---|---|---|
| 2016/0047381 | A1* | 2/2016 | Tanaka | F04C 18/0215 418/55.1 |
| 2017/0002816 | A1* | 1/2017 | Uekawa | F04C 29/026 418/55.6 |
| 2018/0231002 | A1 | 8/2018 | Lee | |

FOREIGN PATENT DOCUMENTS

| | | | |
|---|---|---|---|
| WO | 2013/175623 | A1 | 11/2013 |
| WO | 2014/155923 | A1 | 10/2014 |
| WO | 2015/079711 | A1 | 6/2015 |
| WO | 2018/220698 | A1 | 12/2018 |

OTHER PUBLICATIONS

International Search Report and Written Opinion, International Patent Application No. PCT/JP2022/021895, Jun. 28, 2022, with English translation of Search Report (10 pages).

* cited by examiner

[Fig. 1]
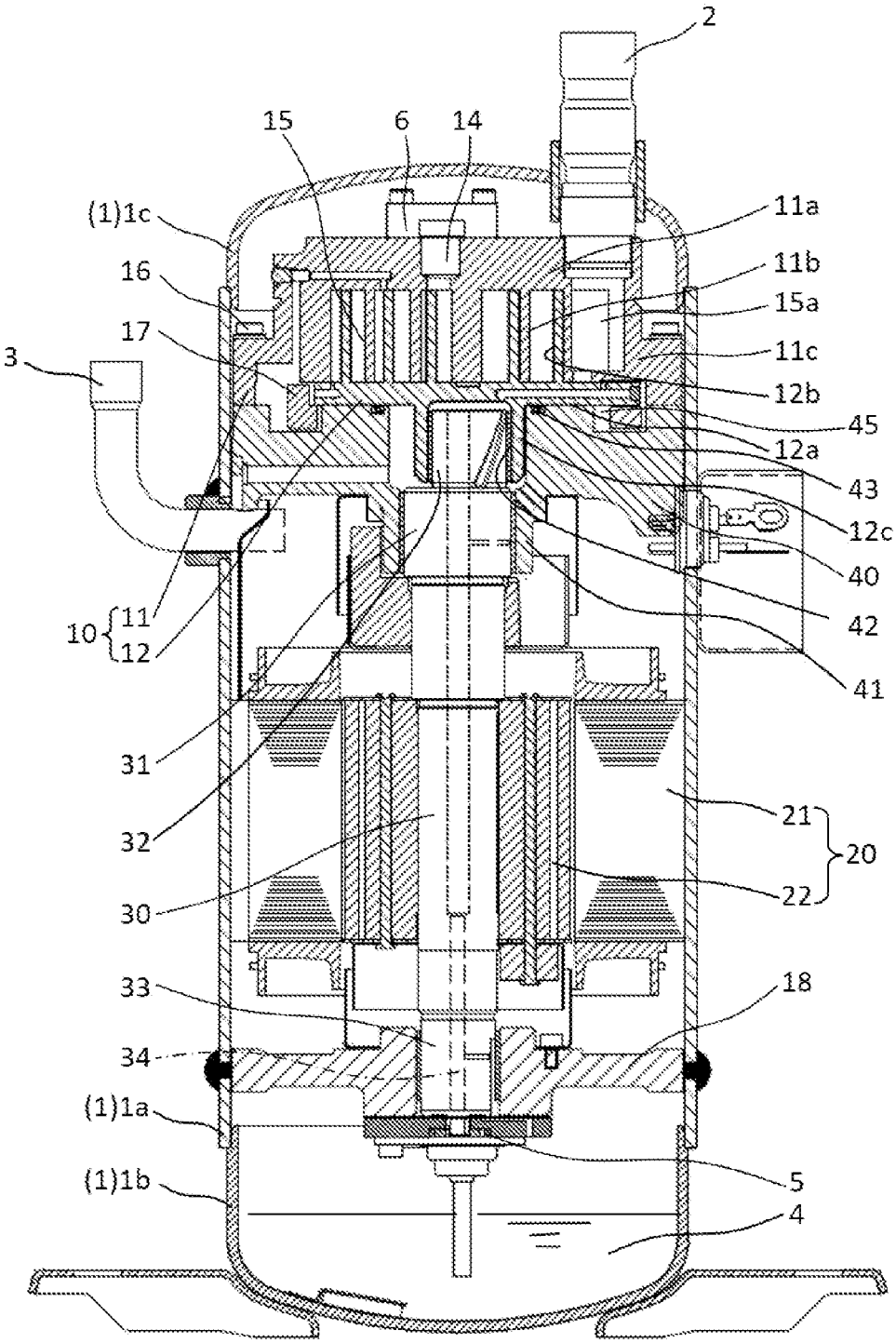

[Figs. 2]
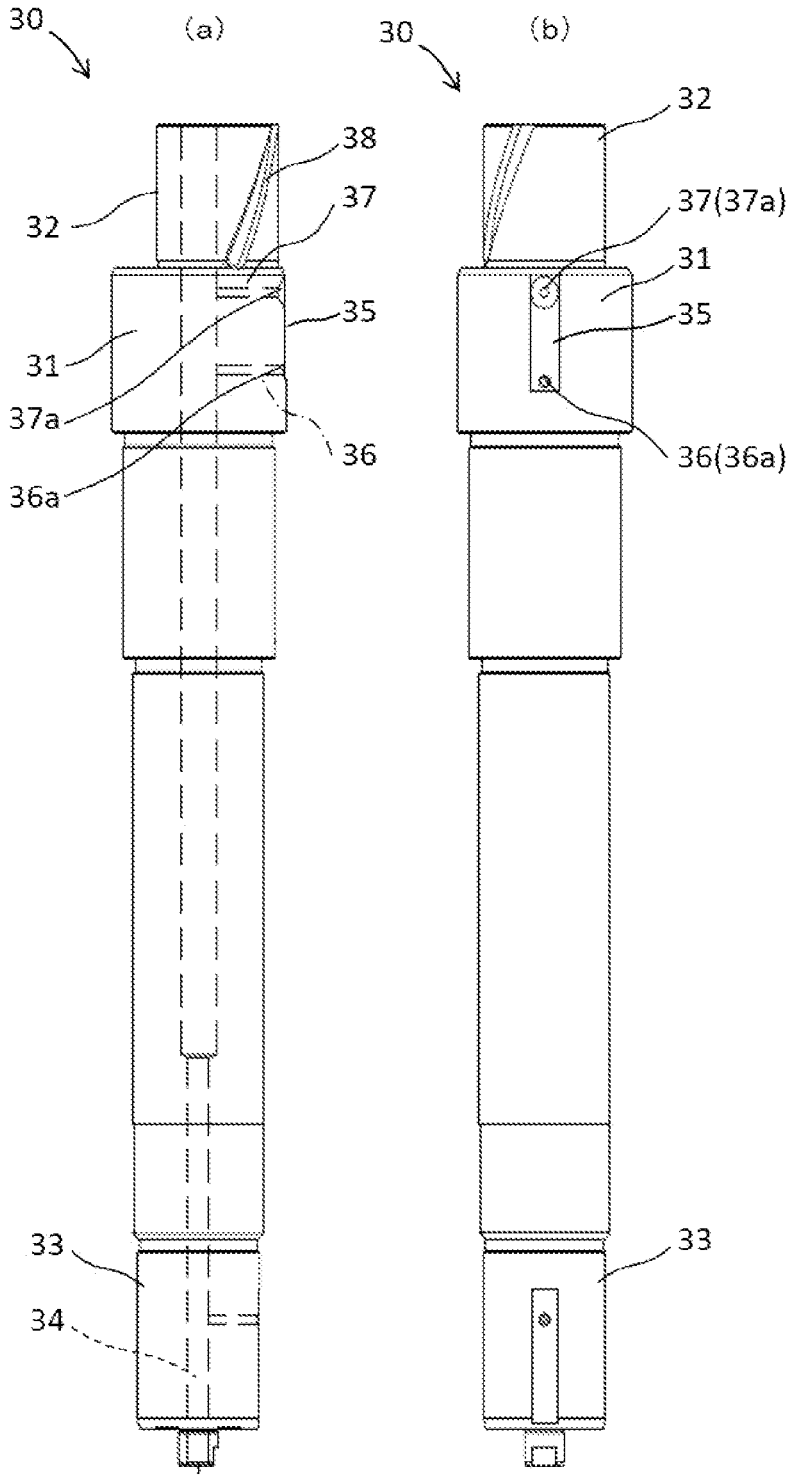

[Fig. 3]
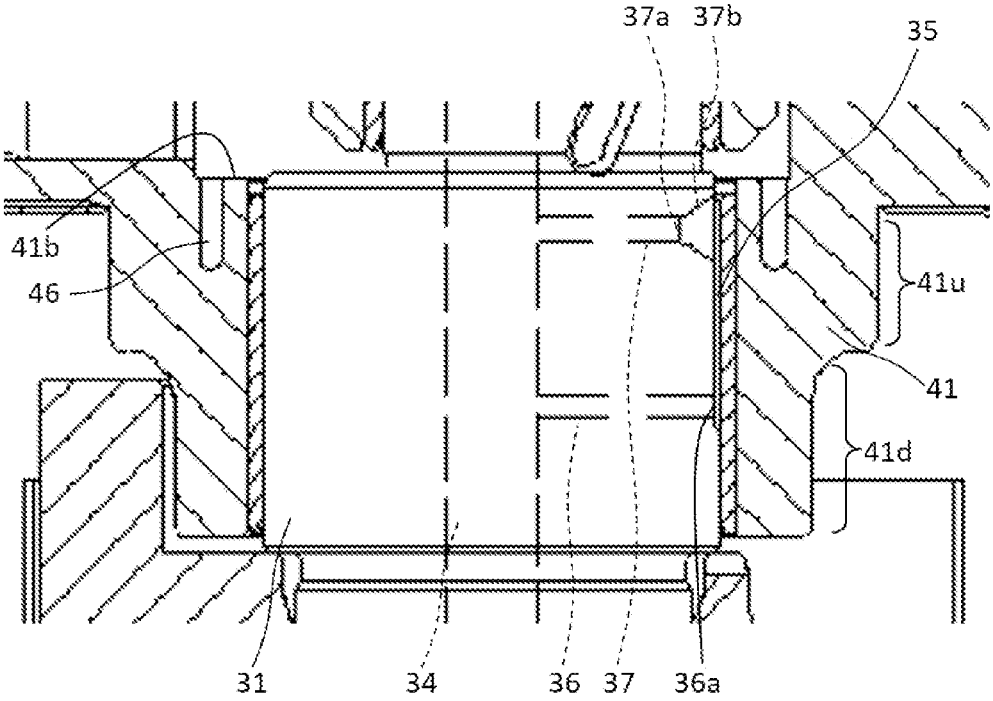

[Figs. 4]
(a)
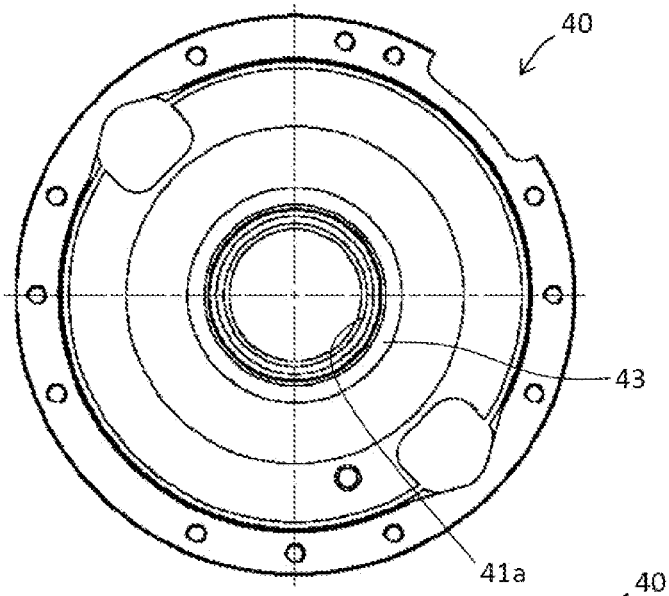
(b)
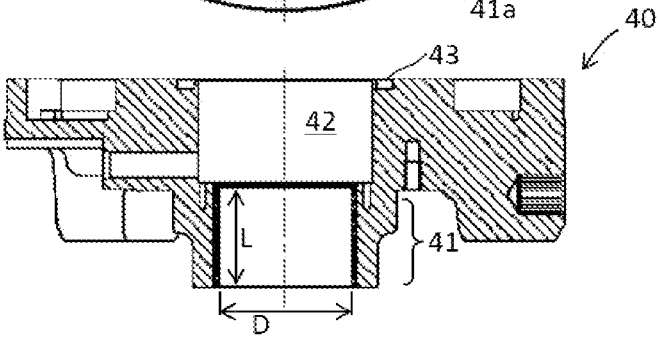
(c)
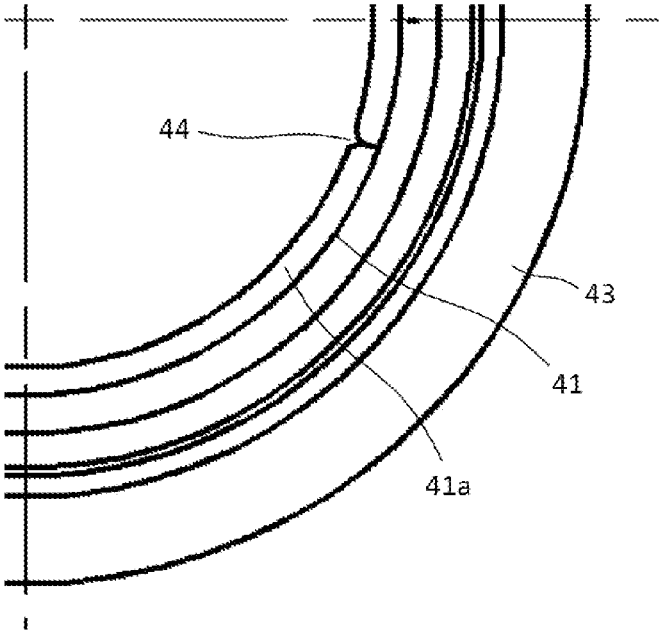

[Figs. 5]
(a)
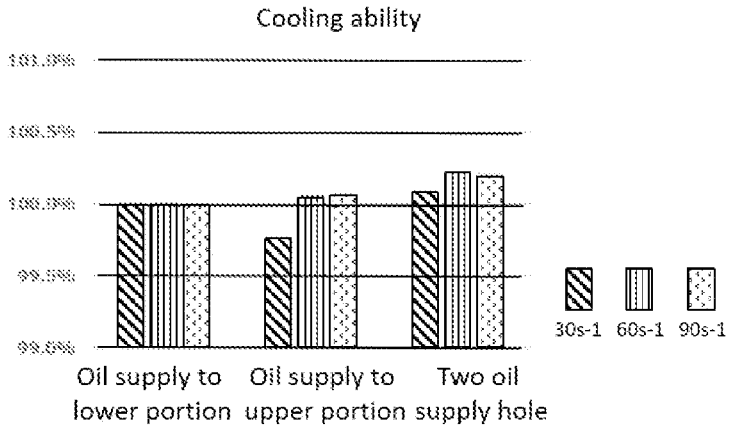
(b)
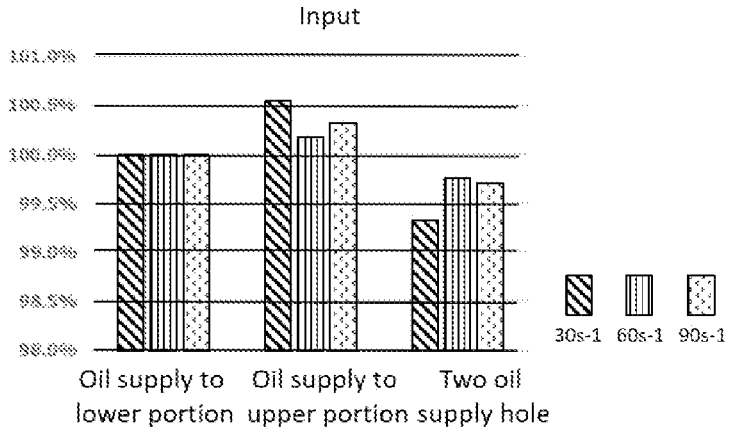
(c)
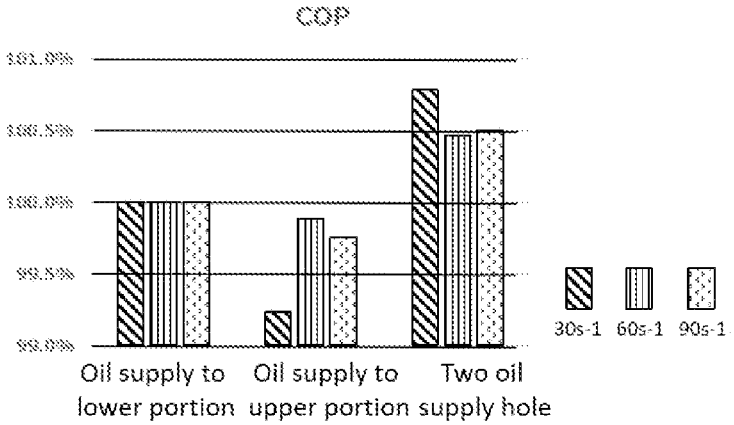

SCROLL COMPRESSOR

TECHNICAL FIELD

The present invention relates to a scroll compressor used in a cooling device such as an air conditioner and a refrigerator, or used in a freezing machine such as a heat pump hot water supply device.

BACKGROUND TECHNIQUE

According to a scroll compressor described in patent document 1, a journal placed in a bearing, an eccentric shaft inserted into a boss portion, and a main shaft oil supply hole extending from a lower end of a main shaft to the eccentric shaft are formed in the main shaft. A groove having a predetermined length is formed in the journal, and an oil supply hole which is in communication with the main shaft oil supply hole and which opens from a vertical groove is formed.

PRIOR ART DOCUMENT

Patent Document

[Patent Document 1] Japanese Patent Application Laid-open No. 2004-11482

SUMMARY OF THE INVENTION

Problem to be Solved by the Invention

However, according to the scroll compressor described in patent document 1, since the groove formed in the journal does not have a passage through which lubricant oil is discharged, lubricant oil supplied from the oil supply hole to the groove does not easily flow out from the groove. Therefore, the lubricant oil is not easily supplied from the oil supply hole to the groove, and sufficient lubricant oil is not supplied to the journal. Hence, cooling ability and COP are deteriorated, or the bearing is damaged.

Hence, it is an object of the present invention to provide a scroll compressor capable of reducing damage of the bearing by increasing an oil supply amount to the bearing, and capable of enhancing the cooling ability and the COP.

Means for Solving Problem

In a scroll compressor of the present invention described in a first aspect, a compression mechanism portion 10 for compressing refrigerant, an electric mechanism portion 20 for driving the compression mechanism portion 10, and a main shaft 30 which is rotated by the electric mechanism portion 20 and which operates the compression mechanism portion 10 are placed in a hermetical container 1, an oil reservoir 4 is formed in a bottom in the hermetical container 1, the compression mechanism portion 10 includes a fixed scroll 11 and a turning scroll 12, the fixed scroll 11 includes a disc-shaped fixed scroll end plate 11*a* and a fixed scroll lap 11*b* standing on the fixed scroll end plate 11*a*, the turning scroll 12 includes a disc-shaped turning scroll end plate 12*a*, a turning scroll lap 12*b* standing on a lap-side end surface of the turning scroll end plate 12*a*, and a boss portion 12*c* formed on a side opposite from the lap-side end surface of the turning scroll end plate 12*a*, the fixed scroll lap 11*b* and the turning scroll lap 12*b* mesh with each other, and a plurality of compression chambers 15 are formed between the fixed scroll lap 11*b* and the turning scroll lap 12*b*, a main bearing 40 which supports the fixed scroll 11 and the turning scroll 12 is provided below the fixed scroll 11 and the turning scroll 12, a bearing 41 which pivotally supports the main shaft 30, and a boss-accommodating section 42 for accommodating the boss portion 12*c* are formed on the main bearing 40, a journal 31 placed in the bearing 41, an eccentric shaft 32 inserted into the boss portion 12*c*, and a main shaft oil supply hole 34 extending from a lower end 33 of the main shaft 30 to the eccentric shaft 32, and lubricant oil existing in the oil reservoir 4 is introduced into the bearing 41 through the main shaft oil supply hole 34, wherein a vertical groove 35 is formed in the journal 31 such that the vertical groove 35 has a predetermined length measured from an upper end of the journal 31, a first oil supply hole 36 and a second oil supply hole 37 which are in communication with the main shaft oil supply hole 34 and which open from the vertical groove 35 are formed, a first opening 36*a* of the first oil supply hole 36 is located on a side of a lower end of the vertical groove 35, and a second opening 37*a* of the second oil supply hole 37 is located on a side of an upper end of the vertical groove 35.

According to the invention described in a second aspect, in the scroll compressor described in the first aspect, the second opening 37*a* is enlarged by a chamfer portion 37*b*.

According to the invention described in a third aspect, in the scroll compressor described in the first or second aspect, an upper portion 41*u* of the bearing 41 is a thick portion as compared with a lower portion 41*d* of the bearing 41, the first opening 36*a* is located in the lower portion 41*d* of the bearing 41, and the second opening 37*a* is located in the upper portion 41*u* of the bearing 41.

According to the invention described in a fourth aspect, in the scroll compressor described in any one of the first to the third aspects, a slit 44 extending from an upper end to a lower end of the bearing 41 is formed in an inner peripheral surface of the bearing 41.

According to the invention described in a fifth aspect, in the scroll compressor described in the fourth aspect, a bush 41*a* is placed on an inner periphery of the bearing 41, and the slit 44 is formed by the bush 41*a*.

According to the invention described in a sixth aspect, in the scroll compressor described in any one of the first to the fifth aspects, a ring-shaped flexible groove 46 is formed in an upper end surface 41*b* of the bearing 41.

According to the invention described in a seventh aspect, in the scroll compressor described in any one of the first to the sixth aspects, if an entire length of the bearing 41 is defined as L and an inner diameter of the bearing 41 is defined as D, a relation $L/D \leq 1$ is established.

According to the invention described in an eighth aspect, in the scroll compressor described in any one of the first to the seventh aspects, number of rotations of 30 $s^{-1}$ or less is included in an operation range.

Effect of the Invention

According to the present invention, since the vertical groove reaches the upper end of the journal, lubricant oil supplied to the vertical groove is discharged from the upper end of the journal. Therefore, sufficient lubricant oil is supplied from the first and second oil supply holes to the vertical groove. The first opening of the first oil supply hole is located on the side of the lower end of the vertical groove, and the second opening of the second oil supply hole is located on the side of the upper end of the vertical groove. According to this, an amount of lubricant oil which is supplied to the vertical groove can be increased with balance. Hence, it is possible to enhance the cooling ability and the COP, and to reduce an input. Further, damage of the upper end of the bearing can be reduced.

BRIEF DESCRIPTION OF THE DRAWINGS

FIG. 1 is a vertical sectional view of a scroll compressor according to an embodiment of the present invention;

FIG. 2 are side views showing a main shaft of the scroll compressor shown in FIG. 1;

FIG. 3 is a sectional view showing a bearing and a journal of the scroll compressor shown in FIG. 1;

FIG. 4 are diagrams showing the main bearing of the scroll compressor shown in FIG. 1; and FIG. 5 are diagrams showing a result of performance confirmation of the scroll compressor shown in FIG. 1.

MODE FOR CARRYING OUT THE INVENTION

According to a scroll compressor of a first embodiment of the present invention, a vertical groove is formed in the journal such that the vertical groove has a predetermined length measured from an upper end of the journal, a first oil supply hole and a second oil supply hole which are in communication with the main shaft oil supply hole and which open from the vertical groove are formed, a first opening a of the first oil supply hole is located on a side of a lower end of the vertical groove, and a second opening of the second oil supply hole is located on a side of an upper end of the vertical groove. According to this embodiment, since the vertical groove reaches the upper end of the journal, lubricant oil supplied to the vertical groove is discharged from the upper end of the journal. Therefore. sufficient lubricant oil is supplied to the vertical groove from the first and second oil supply holes. Further, the first opening of the first oil supply hole is located on the side of the lower end of the vertical groove, and the second opening of the second oil supply hole is located on the side of the upper end of the vertical groove. Therefore, an amount of lubricant oil supplied to the vertical groove can be increased with balance. Hence, it is possible to enhance the cooling ability and the COP, and to reduce the input. Further, damage of the upper end of the bearing can be reduced.

According to a second embodiment of the invention, in the scroll compressor of the first embodiment, the second opening is enlarged by a chamfer portion. According to this embodiment, the second opening can be enlarged by the chamfer portion, high pressure (since centrifugal force caused by rotation of main shaft is applied) lubricant oil discharged from the second oil supply hole can be supplied to the upper end of the bearing extensively.

According to a third embodiment of the invention, in the scroll compressor of the first or second embodiment, an upper portion of the bearing is a thick portion as compared with a lower portion of the bearing, the first opening is located in the lower portion of the bearing, and the second opening is located in the upper portion of the bearing. According to this embodiment, the second opening is located in the upper portion of the bearing which becomes a thick portion. Therefore, it is possible to reduce damage of the thick portion (upper end of bearing) which is less prone to be deformed. Further, it is possible to enhance the cooling ability and the COP, and to reduce the input.

According to a fourth embodiment of the invention, in the scroll compressor of any one of the first to third embodiments, a slit extending from an upper end to a lower end of the bearing is formed in an inner peripheral surface of the bearing. According to this embodiment, when the vertical groove passes through the slit by the rotation of the main shaft, lubricant oil can be discharged from the slit. Therefore, it is possible to supply oil also to the lower end of the journal where there is no vertical groove.

According to a fifth embodiment of the invention, in the scroll compressor of the fourth embodiment, a bush is placed on an inner periphery of the bearing, and the slit is formed by the bush. According to this embodiment, the sit can be formed by the bush.

According to a sixth embodiment of the invention, in the scroll compressor of any one of the first to fifth embodiments, a ring-shaped flexible groove is formed in an upper end surface b of the bearing. According to this embodiment, by forming the flexible groove on an upper portion of the bearing which becomes the thick portion, deformation can easily occur, and it is possible to reduce stress which is generated in the upper end of the bearing by a bearing load.

According to a seventh embodiment of the invention, in the scroll compressor of any one of the first to sixth embodiments, if an entire length of the bearing is defined as L and an inner diameter of the bearing is defined as D, a relation $L/D \leq 1$ is established. According to this embodiment, high effect can be exhibited in a bearing in which $L/D \leq 1$ is established.

According to an eighth embodiment of the invention, in the scroll compressor of any one of the first to seventh embodiments, number of rotations of 30 $s^{-1}$ or less is included in an operation range. According to this embodiment, high effect can be exhibited when the number of rotations is 30 $s^{-1}$ or less.

Embodiment

A scroll compressor according to an embodiment of the present invention will be described below. The invention is not limited to the embodiment.

FIG. 1 is a vertical sectional view of the scroll compressor according to the embodiment.

A hermetical container 1 is provided therein with a compression mechanism portion 10 which compresses refrigerant, an electric mechanism portion 20 which drives the compression mechanism portion 10, and a main shaft 30 which is rotated by the electric mechanism portion 20 and which operates the compression mechanism portion 10.

The hermetical container 1 is composed of a vertically extending cylindrical body portion 1*a*, an upper lid 1*c* for closing an upper opening of the body portion 1*a*, and a lower lid 1*b* for closing a lower opening of the body portion 1*a*.

The hermetical container 1 includes a refrigerant sucking pipe 2 for introducing refrigerant into the compression mechanism portion 10, and a refrigerant discharging pipe 3 for discharging refrigerant compressed by the compression mechanism portion 10 to outside of the hermetical container 1.

The compression mechanism portion 10 includes a fixed scroll 11 and a turning scroll 12. The turning scroll 12 is turned and driven by the main shaft 30.

The electric mechanism portion 20 includes a stator 21 fixed to the hermetical container 1, and a rotor 22 placed inside of the stator 21. The main shaft 30 is fixed to the rotor 22.

A main bearing 40 which supports the fixed scroll 11 and the turning scroll 12 is provided below the fixed scroll 11 and the turning scroll 12.

A bearing 41 for pivotally supporting the main shaft 30, a boss-accommodating section 42, a sealing ring-shaped recess 43 and a rotation restraint member ring-shaped recess 45 are formed on or in the main bearing 40. The main bearing 40 is fixed to the hermetical container 1 by welding or shrink fitting.

The fixed scroll 11 includes a disc-shaped fixed scroll end plate 11*a*, a fixed scroll lap 11*b* standing on the fixed scroll end plate 11*a*, and an outer peripheral wall 11*c* standing such that it surrounds a periphery of the fixed scroll lap 11*b*. A discharge port 14 is formed in a substantially central portion of the fixed scroll end plate 11*a*. The discharge port 14 is provided with a discharge valve (not shown).

The turning scroll 12 includes a disc-shaped turning scroll end plate 12*a*, a turning scroll lap 12*b* standing on a lap-side end surface of the turning scroll end plate 12*a*, and a cylindrical boss portion 12*c* formed on a side opposite from a lap-side end surface of the turning scroll end plate 12*a*.

The fixed scroll lap 11*b* of the fixed scroll 11 and the turning scroll lap 12*b* of the turning scroll 12 mesh with each other. A plurality of compression chambers 15 are formed between the fixed scroll lap 11*b* and the turning scroll lap 12*b*.

The boss portion 12*c* is formed on a substantially central portion of the turning scroll end plate 12*a*. The boss portion 12*c* is accommodated in the boss-accommodating section 42.

A journal 31 placed on the bearing 41, an eccentric shaft 32 inserted into the boss portion 12*c*, and a main shaft oil supply hole 34 extending from a lower end 33 of the main shaft 30 to the eccentric shaft 32 are formed on or in the main shaft 30. The eccentric shaft 32 is formed on an upper end of the main shaft 30, and the journal 31 is formed below the eccentric shaft 32.

The outer peripheral wall 11*c* of the fixed scroll 11 is fixed to the main bearing 40 using a plurality of bolts 16. On the other hand, the turning scroll 12 is supported by the fixed scroll 11 through a rotation restraint member 17 such as Oldham's ring. The rotation restraint member 17 restricts rotation of the turning scroll 12. The rotation restraint member 17 is placed in the rotation restraint member ring-shaped recess 45, and is placed between the fixed scroll 11 and the main bearing 40. According to this, the turning scroll 12 does not rotate with respect to the fixed scroll 11 and turns.

The lower end 33 of the main shaft 30 is pivotally supported by an auxiliary bearing 18 which is placed in a lower end of the hermetical container 1.

An oil reservoir 4 for storing lubricant oil is formed in a bottom of the hermetical container 1.

A displacement oil pump 5 is provided at a lower end of the main shaft 30. The oil pump 5 is placed such that its suction port exists in the oil reservoir 4. The oil pump 5 is driven by the main shaft 30. The oil pump 5 can reliably suck up lubricant oil existing in the oil reservoir 4 provided in the bottom of the hermetical container 1 irrespective of pressure conditions and driving speed. Therefore, the anxiety of out of oil is resolved.

The lubricant oil which is sucked up by the oil pump 5 is supplied into a bearing of the auxiliary bearing 18, the bearing 41 and the boss portion 12*c* through the main shaft oil supply hole 34 formed in the main shaft 30.

Refrigerant sucked from the refrigerant sucking pipe 2 is introduced into the compression chambers 15 from a suction port 15*a*. The compression chambers 15 move while reducing their volumes from an outer peripheral side toward a center. Pressure of the refrigerant reaches a predetermined value in the compression chambers 15. The refrigerant whose pressure reaches the predetermined value pushes and opens the discharge valve from the discharge port 14 and the refrigerant is discharged into a discharge chamber 6, and is derived to an upper portion in the hermetical container 1. The derived refrigerant passes through a refrigerant passage (not shown) formed in the compression mechanism portion 10, the refrigerant reaches a periphery of the electric mechanism portion 20, and the refrigerant is discharged out from the refrigerant discharging pipe 3.

In the scroll compressor of this embodiment, the boss-accommodating section 42 is a high pressure region, and an outer periphery of the turning scroll 12 where the rotation restraint member 17 is placed is an intermediate pressure region. Pressures of the high pressure region and the intermediate pressure region push the turning scroll 12 against the fixed scroll 11.

The eccentric shaft 32 is inserted into the boss portion 12*c* through a slewing bearing such that the eccentric shaft 32 can turn and can be driven. An oil groove 38 (see FIG. 2) is formed in an outer peripheral surface of the eccentric shaft 32.

The sealing ring-shaped recess 43 is formed in a thrust surface of the main bearing 40. The thrust surface of the main bearing 40 receives a thrust force of the turning scroll end plate 12*a*. The sealing ring-shaped recess 43 is provided with a ring-shaped seal member. The seal member is placed on an outer periphery of the boss-accommodating section 42.

The hermetical container 1 is filled with refrigerant having the same high pressure as that of refrigerant which is discharged into the discharge chamber 6. The main shaft oil supply hole 34 opens from an upper end of the eccentric shaft 32. Therefore, pressure in the boss portion 12*c* is high pressure region which is equal to pressure of discharged refrigerant.

The lubricant oil passes through the main shaft oil supply hole 34 and is introduced into the boss portion 12*c*. The lubricant oil is supplied into the slewing bearing and the boss-accommodating section 42 by the oil groove 38 formed in the outer peripheral surface of the eccentric shaft 32. Since a seal member is provided on an outer periphery of the boss-accommodating section 42, pressure in the boss-accommodating section 42 is high pressure region.

FIG. 2 are side views showing the main shaft of the scroll compressor shown in FIG. 1.

A vertical groove 35 is formed in the journal 31 such that the vertical groove 35 has a predetermined length measured from an upper end of the journal 31. A first oil supply hole 36 and a second oil supply hole 37 are formed in the journal 31. The first and second oil supply holes 36 and 37 are in communication with the main shaft oil supply hole 34 and open from the vertical groove 35. The first and second oil supply holes 36 and 37 are formed in a radial direction of the journal 31. The first and second oil supply holes 36 and 37 have the same hole diameters.

A first opening 36*a* of the first oil supply hole 36 is located on the side of a lower end of the vertical groove 35, and a second opening 37*a* of the second oil supply hole 37 is located on the side of an upper end of the vertical groove 35.

The second opening 37*a* is enlarged by a chamfer portion 37*b* (see FIG. 3). Although the chamfer portion 37*b* is formed into a circular shape in this embodiment, the chamfer portion 37*b* may be formed into other shapes such as an elliptically shape. However, it is preferable that the chamfer portion 37*b* is enlarged to a length which is almost the same as a width of the vertical groove 35 in the vertical direction of the vertical groove 35.

Lubricant oil existing in the oil reservoir 4 is introduced into an inner peripheral surface of the bearing 41 through the main shaft oil supply hole 34, the first oil supply hole 36 and the second oil supply hole 37.

Since the vertical groove 35 reaches the upper end of the journal 31 in this manner, lubricant oil supplied to the vertical groove 35 is discharged out from the upper end of the journal 31. Therefore, sufficient lubricant oil is supplied to the vertical groove 35 from the first and second oil supply holes 36 and 37. The first opening 36*a* of the first oil supply hole 36 is located on the side of the lower end of the vertical groove 35, and the second opening 37*a* of the second oil supply hole 37 is located on the side of the upper end of the vertical groove 35. Therefore, an amount of lubricant oil supplied to the vertical groove 35 can be increased with balance, and damage of the upper end of the bearing is reduced. Hence, it is possible to enhance the cooling ability and the COP and to reduce an input.

Further, by enlarging the second opening 37*a* by the chamfer portion 37*b*, lubricant oil having high oil pressure (because centrifugal force caused by rotation of main shaft is applied) discharged from the second oil supply hole 37 can extensively be supplied to the upper end of the bearing.

FIG. 3 is a sectional view showing the bearing and the journal of the scroll compressor shown in FIG. 1.

An upper portion 41*u* of the bearing 41 is a thick portion as compared with a lower portion 41*d* of the bearing 41.

The first opening 36*a* is located in the lower portion 41*d* of the bearing 41, and the second opening 37*a* is located in an upper portion 41*u* of the bearing 41.

The second opening 37*a* is located with respect to the upper portion 41*u* (upper end of bearing) of the bearing 41 which is the thick portion. According to this, damage against the thick portion which is less prone to be deformed can be reduced. Hence, it is possible to enhance the cooling ability and the COP and to reduce the input.

A bush 41*a* (see FIG. 4) is placed on an inner periphery of the bearing 41.

A ring-shaped flexible groove 46 is formed in an upper end surface 41*b* of the bearing 41. By forming the flexible groove 46 in the upper portion 41*u* of the bearing 41 which is the thick portion, deformation can occur easily.

FIG. 4 are diagrams showing the main bearing of the scroll compressor shown in FIG. 1.

FIG. 4 (*a*) is a top view of the main bearing, FIG. 4 (*b*) is a side sectional view of the main bearing, and FIG. 4 (*c*) is an enlarged view of an essential portion of FIG. 4 (*a*).

As shown in FIG. 4 (*b*), if an entire length of the bearing 41 is defined as L and an inner diameter of the bearing 41 is defined as D, a relation $L/D \leq 1$ is established. In this embodiment, high effect is exerted on the bearing 41 having the relation of $L/D \leq 1$.

It is preferable that a slit 44 extending from an upper end to a lower end of the bearing 41 is formed on an inner peripheral surface of the bearing 41 as shown in FIG. 4 (*c*). By forming such a slit 44, lubricant oil can be discharged from the slit 44 when the vertical groove 35 passes through the slit 44 by rotation of the main shaft 30. Hence, it is possible to supply oil also to a portion where there is no vertical groove of the journal 31. In this embodiment, the bush 41*a* is placed on the inner periphery of the bearing 41, and the slit 44 is formed by the bush 41*a*.

FIG. 5 are diagrams showing a: result of performance confirmation of the scroll compressor shown in FIG. 1.

FIG. 5 (*a*) shows cooling ability, FIG. 5 (*b*) shows input and FIG. 5 (*c*) shows COP. The number of rotations was set to 30 $s^{-1}$, 60 $s^{-1}$ and 90 $s^{-1}$, and performances were compared.

Oil supply to the lower portion is a comparative example in which only the first oil supply hole 36 is provided, oil supply to the upper portion is a comparative example in which only the second oil supply hole 37 is provided, and in this embodiment, two oil supply holes are the first oil supply hole 36 and the second oil supply hole 37. Comparison is made under a condition that the oil supply to the lower portion as the comparison example in which only the first oil supply hole 36 is provided is defined as 100%.

As shown in FIG. 5 (*a*), in the case of any number of rotations, the cooling ability of this embodiment is increased, and the effect especially at the intermediate number of rotations (60 $s^{-1}$, 90 $s^{-1}$) is high.

As shown in FIG. 5 (*b*), in the case of any number of rotations, input of this embodiment is lowered, and the effect especially at the low number of rotations (30 $s^{-1}$) is high.

As shown in FIG. 5 (*c*), in the case of any number of rotations, COP of this embodiment is increased, and the effect especially at the low number of rotations (30 $s^{-1}$) is high.

As described above, since the effect is high when the number of rotation is equal to or lower than 30 $s^{-1}$, the scroll compressor is an inverter scroll compressor in which the number of rotations is variable. Therefore, this embodiment is most suitable for a compressor in which the number of rotations of 30 $s^{-1}$ or less is included in the operation range.

INDUSTRIAL APPLICABILITY

The scroll compressor of the present invention is useful for a refrigeration cycle device used in such as a hydronic heater, an air conditioner, a hot water supply device and a freezing machine.

Explanation of Symbols

1 hermetical container
1*a* body portion
1*b* lower lid
1*c* upper lid
2 refrigerant sucking pipe
3 refrigerant discharging pipe
4 oil reservoir
5 oil pump
6 discharge chamber
10 compression mechanism portion
11 fixed scroll
11*a* fixed scroll end plate
11*b* fixed scroll lap
11*c* outer peripheral wall
12 turning scroll
12*a* turning scroll end plate
12*b* turning scroll lap
12*c* boss portion
14 discharge port
15 compression chamber
15*a* suction port
16 bolt
17 rotation restraint member
18 auxiliary bearing
20 electric mechanism portion
21 stator
22 rotor

30 main shaft
31 journal
32 eccentric shaft
33 lower end
34 main shaft oil supply hole
35 vertical groove
36 first oil supply hole
36*a* first opening
37 second oil supply hole
37*a* second opening
37*b* chamfer portion
38 oil groove
40 main bearing
41 bearing
41*a* bush
41*b* upper end surface
41*d* lower portion
41*u* upper portion (upper end of bearing)
42 boss-accommodating section
43 sealing ring-shaped recess
44 slit
45 rotation restraint member ring-shaped recess
46 flexible groove

The invention claimed is:

1. A scroll compressor comprising:

a compression mechanism portion for compressing refrigerant;

an electric mechanism portion for driving the compression mechanism portion;

a main shaft which is rotated by the electric mechanism portion and which operates the compression mechanism portion;

a hermetical container in which the compression mechanism portion, the electric mechanism portion, and the main shaft are present; and an oil reservoir formed in a bottom in the hermetical container, wherein the compression mechanism portion includes a fixed scroll and a turning scroll, the fixed scroll includes a disc-shaped fixed scroll end plate and a fixed scroll lap standing on the fixed scroll end plate, the turning scroll includes a disc-shaped turning scroll end plate, a turning scroll lap standing on a lap-side end surface of the turning scroll end plate, and a boss portion formed on a side opposite from the lap-side end surface of the turning scroll end plate, the fixed scroll lap and the turning scroll lap mesh with each other, and a plurality of compression chambers are formed between the fixed scroll lap and the turning scroll lap, a main bearing which supports the fixed scroll and the turning scroll is provided below the fixed scroll and the turning scroll, a bearing which pivotally supports the main shaft, and a boss-accommodating section for accommodating the boss portion are formed on the main bearing, a journal present in the bearing, an eccentric shaft inserted into the boss portion, and a main shaft oil supply hole extending from a lower end of the main shaft to the eccentric shaft are formed in the main shaft, lubricant oil existing in the oil reservoir is introduced into the bearing through the main shaft oil supply hole, a vertical groove is formed in the journal such that the vertical groove has a predetermined length measured from an upper end of the journal, and the vertical groove reaches the upper end of the journal, a first oil supply hole and a second oil supply hole are formed in communication with the main shaft oil supply hole and open from the vertical groove, a first opening of the first oil supply hole is located on a side of a lower end of the vertical groove, and a second opening of the second oil supply hole is located on a side of an upper end of the vertical groove.

2. The scroll compressor according to claim 1, wherein the second opening is enlarged by a chamfer portion.

3. The scroll compressor according to claim 1, wherein an upper portion of the bearing is a thick portion as compared with a lower portion of the bearing, the first opening is located in the lower portion of the bearing, and the second opening is located in the upper portion of the bearing.

4. The scroll compressor according to claim 1, wherein a slit extending from an upper end to a lower end of the bearing is formed in an inner peripheral surface of the bearing.

5. The scroll compressor according to claim 4, wherein a bush is placed on an inner periphery of the bearing, and the slit is formed by the bush.

6. The scroll compressor according to claim 1, wherein a ring-shaped flexible groove is formed in an upper end surface of the bearing.

7. The scroll compressor according to claim 1, wherein an entire length of the bearing is equal to or less than an inner diameter of the bearing.

8. The scroll compressor according to claim 1, wherein number of rotations of $30s^{-1}$ or less is included in an operation range.

* * * * *